US009074856B1

(12) United States Patent
Freitag et al.

(10) Patent No.: US 9,074,856 B1
(45) Date of Patent: Jul. 7, 2015

(54) GUN-LAUNCHED ANCHOR PROJECTILE FOR CLIMBING

(71) Applicants: Ryan Robert Freitag, Lebanon, NJ (US); Cameron James Martin, Saugus, CA (US); Patrick Francis Coe, Rochester, MI (US); Kevin Michael Lucas, O'Fallon, IL (US); Brian Michael Walter, Syracuse, NY (US); Christopher Paul Knittle, Lehighton, PA (US)

(72) Inventors: Ryan Robert Freitag, Lebanon, NJ (US); Cameron James Martin, Saugus, CA (US); Patrick Francis Coe, Rochester, MI (US); Kevin Michael Lucas, O'Fallon, IL (US); Brian Michael Walter, Syracuse, NY (US); Christopher Paul Knittle, Lehighton, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/255,185

(22) Filed: Apr. 17, 2014

Related U.S. Application Data

(60) Provisional application No. 61/813,230, filed on Apr. 18, 2013.

(51) Int. Cl.

| | |
|---|---|
| ***F42B 12/68*** | (2006.01) |
| ***F42B 14/06*** | (2006.01) |
| ***F42B 12/02*** | (2006.01) |
| ***A63B 29/02*** | (2006.01) |

(52) U.S. Cl.
CPC ..... *F42B 12/02* (2013.01); *A63B 29/027* (2013.01); *F42B 12/68* (2013.01); *F42B 14/061* (2013.01)

(58) Field of Classification Search
CPC ..... F42B 12/02; F42B 12/68; F42B 14/06; F42B 14/061; F42B 14/068; A63B 29/027
USPC ..... 102/504, 520–523
See application file for complete search history.

(56) References Cited

U.S. PATENT DOCUMENTS

| | | | | |
|---|---|---|---|---|
| 538,626 | A * | 4/1895 | Schmitt | 102/400 |
| 2,857,005 | A * | 10/1958 | Medlock | 169/62 |
| 3,838,532 | A * | 10/1974 | Prodanovich | 42/1.14 |
| 3,886,612 | A * | 6/1975 | Schnirel et al. | 441/85 |
| 3,911,515 | A * | 10/1975 | Rinfret et al. | 441/85 |
| 4,031,840 | A * | 6/1977 | Boisrayon et al. | 114/51 |
| 5,174,384 | A * | 12/1992 | Herman | 169/70 |
| 5,465,980 | A * | 11/1995 | Maurin | 473/578 |
| 7,036,434 | B1 * | 5/2006 | Vo et al. | 102/522 |
| 7,270,060 | B1 * | 9/2007 | Manole et al. | 102/521 |
| 2003/0146045 | A1 * | 8/2003 | Porter, Jr. | 182/11 |
| 2011/0011297 | A1 * | 1/2011 | Eches et al. | 102/521 |

* cited by examiner

*Primary Examiner* — Bret Hayes
(74) *Attorney, Agent, or Firm* — Henry S. Goldfine

(57) ABSTRACT

A gun-launched, penetrating anchor projectile includes a dense, metallic, elongated penetrator having a central bore extending forward from its aft end. An expandable anchor in the form of a hollow cylinder is disposed aft of the penetrator. A spacer and hammer in the form of hollow cylinders are disposed aft of the anchor. A guide tube is disposed radially inward of the anchor, the spacer and the hammer. A semi-rigid cable has one end fixed in the central bore of the penetrator and extends aft through hollow interiors of the expandable anchor, the spacer, and the hammer. The other end of the cable forms a loop on which a pulley is mounted. A discarding sabot and fin assembly are disposed around the projectile.

13 Claims, 4 Drawing Sheets

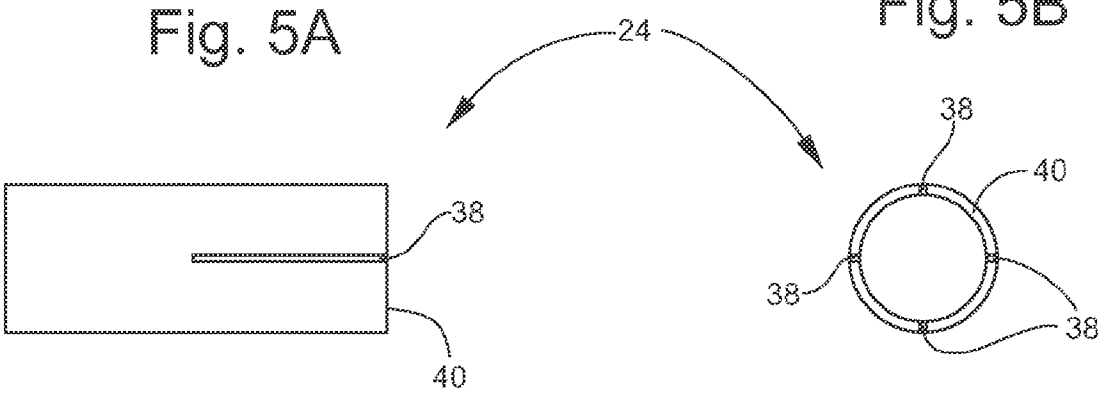
Fig. 5B
Fig. 5A
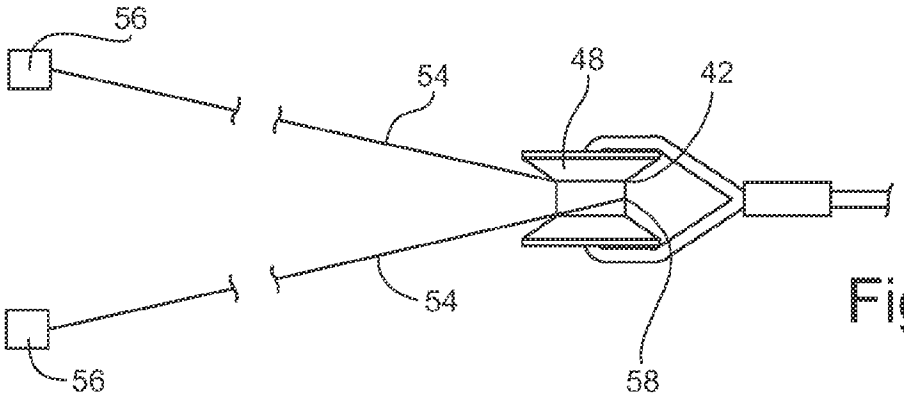
Fig. 6

GUN-LAUNCHED ANCHOR PROJECTILE FOR CLIMBING

CROSS-REFERENCE TO RELATED APPLICATIONS

The present application claims the benefit of priority of U.S. provisional patent application Ser. No. 61/813,230 filed on Apr. 18, 2013, which is incorporated by reference herein.

STATEMENT OF GOVERNMENT INTEREST

The inventions described herein may be manufactured, used and licensed by or for the United States Government.

BACKGROUND OF THE INVENTION

The invention relates in general to climbing anchors and in particular to gun-launched projectiles that create a climbing anchor point in a hard material.

A human cannot easily ascend very steep or vertical obstacles, such as man-made walls or natural obstacles. Climbers may use ropes that are anchored in the obstacle to assist in climbing the obstacle. In some cases, such as military operations, search and rescue, etc., several people must ascend an obstacle quickly. Each climber may be carrying gear weighing tens of pounds. A need exists for a lightweight, inexpensive, secure anchor for steep obstacles that can be embedded in the obstacle quickly and from a distance.

SUMMARY OF INVENTION

One aspect of the invention is a gun-launched, penetrating anchor projectile having a central longitudinal axis. The projectile includes an elongated penetrator made of a dense metallic material and centered on the central longitudinal axis. The elongated penetrator has an aft end that tapers in an aft direction and a central bore extending forward from the aft end. An expandable anchor in the form of a hollow cylinder is disposed aft of the elongated penetrator and centered on the central longitudinal axis.

A spacer made from a brittle material in the form of a hollow cylinder is disposed aft of the expandable anchor and centered on the central longitudinal axis. A hammer made from a dense metallic material in the form of a hollow cylinder is disposed aft of the spacer and centered on the central longitudinal axis. A guide tube in the form of a tube is centered on the central longitudinal axis and disposed radially inward of the expandable anchor, the spacer and the hammer. An outer sheath encloses the elongated penetrator, the expandable anchor, the spacer and the hammer.

A semi-rigid cable is fixed at one end in the central bore of the elongated penetrator and extends in the aft direction through hollow interiors of the expandable anchor, the spacer, and the hammer. The other end of the semi-rigid cable forms a loop that extends through the through bore of a pulley. A discarding sabot is disposed around the projectile. A fin assembly is disposed around the projectile aft of the discarding sabot and forward of the pulley.

The projectile may include a lead line extending around the pulley through the loop of the semi-rigid cable. Masses may be fixed to respective free ends of the lead line.

The expandable anchor may include at least two longitudinal slits formed therein. The slits may begin at a forward end of the anchor, extend aft and be circumferentially equally spaced apart from each other.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIGS. 5A and 5B are side and end views, respectively, of one embodiment of an expandable anchor portion of the projectile of FIG. 2.

FIG. 6 shows a lead line attached to a pulley of the anchor projectile.

DETAILED DESCRIPTION

A penetrating anchor projectile may be used to aid one or more persons in ascending an obstacle, such as a man-made wall or natural formation. The anchor projectile may be gun-launched and may include stabilization fins and a discarding sabot. A climbing rope may be connected to the aft or rear end of the anchor projectile. The forward end of the anchor projectile includes a dense metallic penetrator made of, for example, a heavy tungsten alloy. Aft of the penetrator is an expandable anchor portion to help lodge the penetrator in the obstacle. Aft of the penetrator and the expandable anchor is a hammer portion.

Upon impact of the penetrating anchor projectile with the obstacle, the hammer portion rams the aft end of the expandable anchor portion and thereby forces the forward end of the expandable anchor portion against the aft end of the penetrator. The anchor portion will then expand and help lock the penetrator in place inside the obstacle. The hammer portion may be made of, for example, tungsten. A spacer is disposed between the hammer portion and the expandable anchor portion to provide a time delay for the ramming of the anchor portion by the hammer portion. The time delay provides time for the penetrator to enter the obstacle surface before the hammer portion impacts the anchor portion. The spacer may be made of a brittle material, for example, acrylic.

The penetrating anchor projectile may be gun-launched. The type and caliber of the gun used to launch the anchor projectile may vary. In one embodiment, the gun may be a 40 mm grenade launcher, such as the U.S. Army M203 or M320 grenade launchers. The anchor projectile is seated in a cartridge case containing propellant. The cartridge case with the anchor projectile seated therein is loaded in the gun. The propellant in the cartridge case burns and propels the anchor projectile out of the cartridge case and out of the gun. The manner of seating the anchor projectile in the cartridge case can be analogous to, for example, the manner of seating an armor-piercing fin-stabilized discarding sabot projectile (APFSDS) in its cartridge case. As an alternative to a burning propellant, the anchor projectile may be launched from a compressed gas gun. The anchor projectile may be fired directly into an obstacle to establish an anchor point at any desired location in the obstacle.

Figure 1:
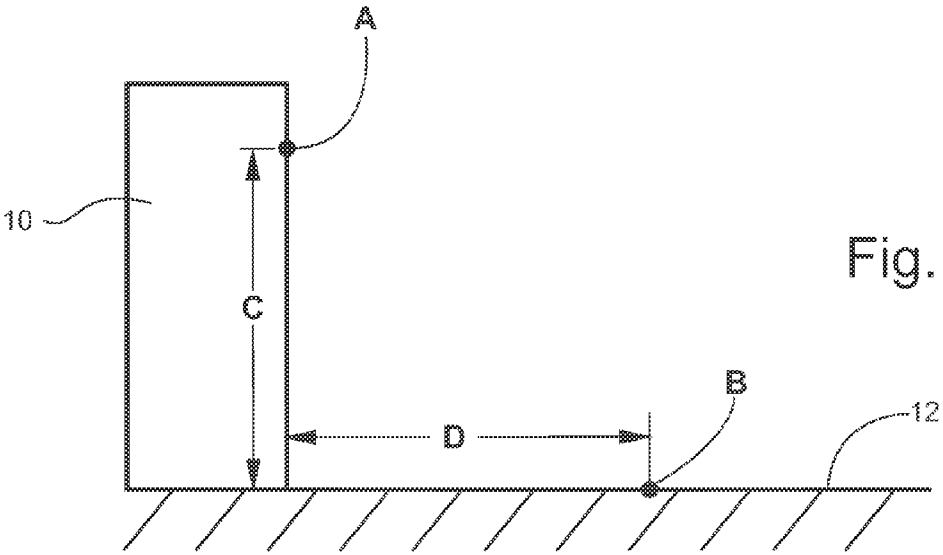
FIG. 1 is a schematic drawing of a vertical obstacle.

FIG. 1 is a schematic drawing showing a vertical obstacle 10 and a ground surface 12. It may be desired to place an anchor projectile at, for example, location A. The anchor projectile is launched from a gun at, for example, location B. By way of example only, the vertical distance C from ground 12 to location A may be around 100 feet and the horizontal distance D between locations A and B may be around 100 feet. Of course, the actual distances C and D will vary depending on the particular obstacle and the capabilities of the weapon system used to launch the anchor projectile.

Figure 2:
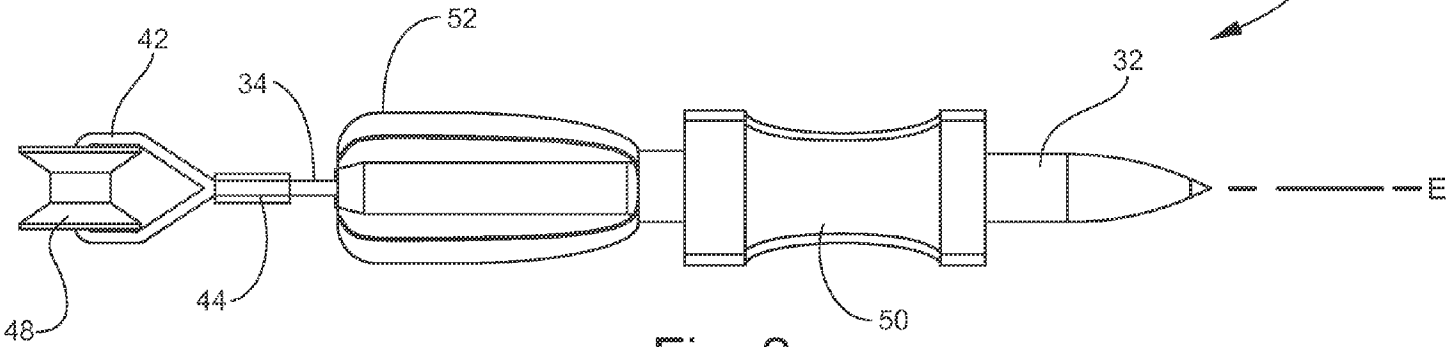
FIG. 2 is a side view of one embodiment of a gun-launched anchor projectile.
Figure 3:
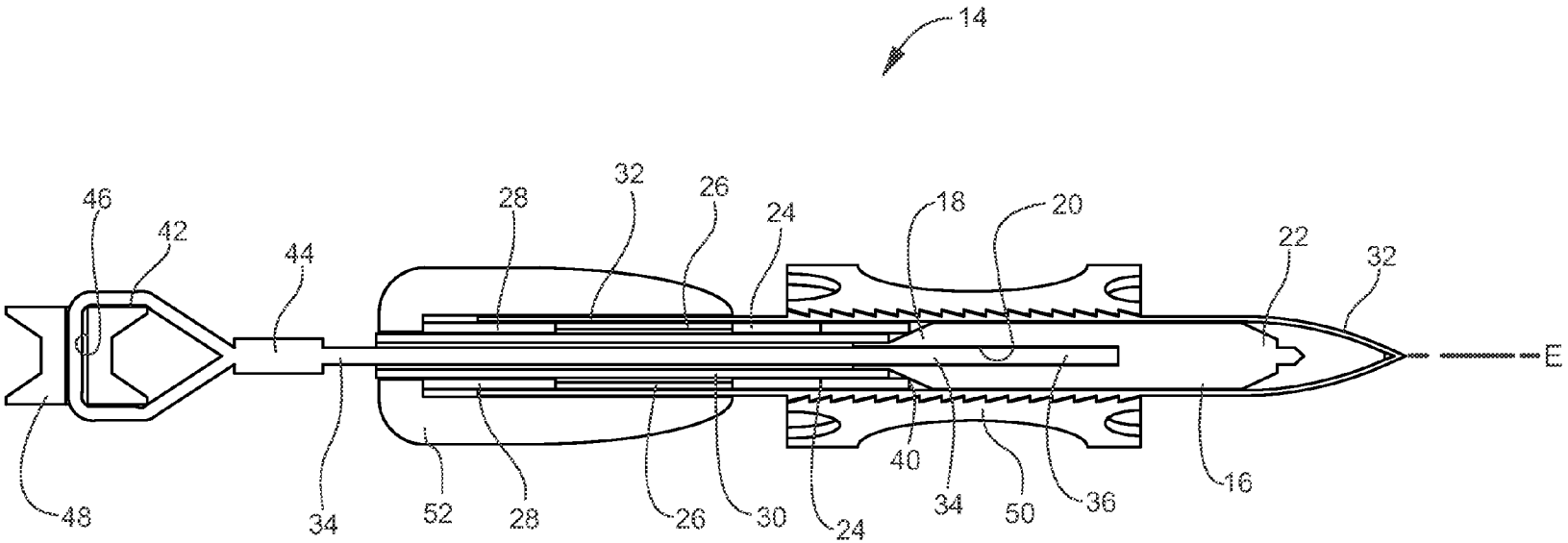
FIG. 3 is longitudinal cutaway view of the projectile of FIG. 2.
Figure 4:
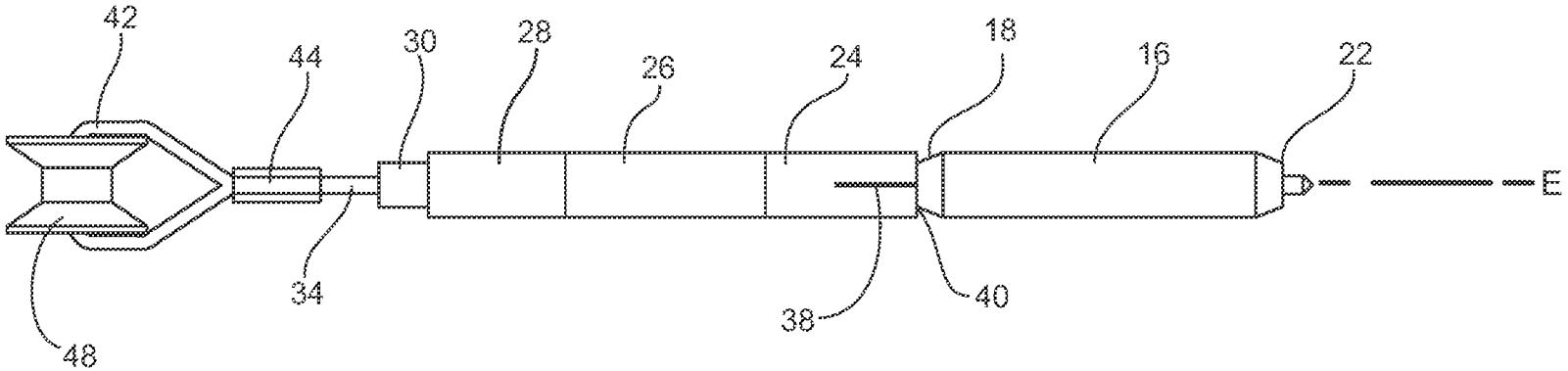
FIG. 4 is a side view of the projectile of FIG. 2 with some components removed to better illustrate the internal components.

FIG. 2 is a side view of one embodiment of a gun-launched anchor projectile 14. FIG. 3 is longitudinal cutaway view of the projectile 14 of FIG. 2. FIG. 4 is a side view of the projectile 14 of FIG. 2 with some components removed to better illustrate the internal components.

Penetrating anchor projectile 14 has a central longitudinal axis E. Projectile 14 includes an elongated, generally cylindrical penetrator 16 (FIGS. 3 and 4) made of a hard, dense metallic material and centered on the central longitudinal axis E. Elongated penetrator 16 has an aft end 18 that tapers in the aft direction and a central bore 20 that extends forward from the aft end 18. The forward end 22 of penetrator 16 may taper in the forward direction. Penetrator 16 is made of a material having a density of at least 10 grams/cubic centimeter. Penetrator 16 may be made of, for example, tungsten or a tungsten alloy. By way of example only, penetrator 16 may be about two to three inches long and about 0.25 inches to about 1 inch in diameter.

Aft of penetrator 16 is an expandable anchor 24 in the form of a hollow cylinder. Anchor 24 is centered on the central longitudinal axis E and abuts the aft end 18 of penetrator 16. Anchor 24 may be made of a relatively easily deformable metal, for example, a low grade carbon steel. As best seen in FIGS. 5A and 5B, expandable anchor 24 includes at least two longitudinal slits 38 formed therein. Slits 38 begin at a forward end 40 of the anchor 24 and extend aft. Slits 38 may be circumferentially equally spaced apart from each other.

A spacer 26 is disposed aft of the expandable anchor 24 and centered on axis E. Spacer 26 may be made from a brittle material in the form of a hollow cylinder. An exemplary material for spacer 26 is acrylic. Aft of spacer 26 is a hammer 28 centered on axis E. Hammer 28 is made of a dense metallic material in the form of a hollow cylinder. Hammer 28 is made of a material having a density of at least 10 grams/cubic centimeter. An exemplary material for hammer 28 is tungsten.

A guide tube 30 in the form of a tube is disposed radially inward of anchor 24, spacer 26 and hammer 28. Guide tube 30 may be made of, for example, aluminum. Hammer 28, spacer 26 and expandable anchor 24 are translatable on the outer radial surface of guide tube 30. However, spacer 26 will disintegrate when rammed by hammer 28, rather than translate any appreciable distance. An outer sheath 32 encloses the elongated penetrator 16, the expandable anchor 24, the spacer 26 and the hammer 28. Sheath 32 may be made of, for example, copper.

A semi-rigid cable 34 is fixed at one end 36 in the central bore 20 of the elongated penetrator 16. Cable 34 may be fixed in bore 20 using, for example, a high strength metal bonder. Cable 34 is centered on axis E and extends in the aft direction through hollow interiors of the expandable anchor 24, the spacer 26, the hammer 28 and the guide tube 30. The other end of cable 34 forms a loop 42, using, for example, a cable crimp or clamp 44. Loop 42 passes through a through bore 46 in a pulley 48.

A discarding sabot 50 is disposed around a portion of projectile 14. The sabot 50 may be made of, for example, three longitudinally separate pieces. Sabot 50 may be made of, for example, aluminum. Sabot 50 may be fixed to outer sheath 32 in a known manner such that sabot 50 separates from sheath 32 after projectile 14 exits the muzzle of the launching tube or gun. The outer diameter of sabot 50 may be varied to accommodate guns of different calibers. A stabilizing tin assembly 52 is disposed aft of the discarding sabot 50 and forward of the pulley 48. The tin assembly 52 may be made of, for example, aluminum.

As seen in FIG. 6, a lead line 54 is fixed at its approximate mid-point 56 to pulley 48. The total length of lead line 54 can vary and should be about twice the maximum anticipated vertical ascent distance (distance C in FIG. 1). Lead line 54 has a relatively small diameter, for example, in a range of about 0.2 to about 1.5 mm. Lead line 54 may be made of materials used for, for example, fishing line. Lead line 54 may be fixed at its mid-point 58 to pulley 48 using, for example, an adhesive material. Each free end of lead line 54 has a small mass 56 attached thereto.

As noted above, anchor projectile 14 is seated in a cartridge case containing propellant. Lead line 54 with masses 56 attached is coiled in the cartridge case proximate pulley 48 with the mid-point of line 54 fixed to pulley 48. The cartridge case with anchor projectile 14 seated therein is loaded in a launching gun. If burning propellant is used, then the propellant in the cartridge case burns and propels the anchor projectile 14 out of the cartridge case and out of the gun. The sabot 50 discards after anchor projectile 14 exits the gun barrel. Projectile 14 contacts and penetrates an obstruction. As hammer 28 decelerates, hammer 28 shatters spacer 26 and rams the aft end of anchor 24. Anchor 24, in turn, translates into the aft end 18 of elongated penetrator 16. Anchor 24 deforms along longitudinal slits 38 thereby forming petals or flanges that extend radially outward from central axis E. The expanded anchor 24 helps secure penetrator 16 in the obstacle.

With penetrator 16 securely lodged in the obstacle, the masses 56 on lead line 54 have dropped down by gravity to ground level. A climber then attaches a climbing rope to one end of lead line 54. The climber pulls the other end of lead line 54 to pull the climbing rope up and through pulley 48 and then down to the climber. Thus, the climber now has a climbing robe threaded through pulley 48. The climber may then ascend the obstacle with the aid of the climbing rope.

The strength of the adhesive used to fix lead line 54 to pulley 48 is sufficient to survive the flight cycle of projectile 14, but will fail when the climber on the ground applies pulling force to one end of line 54 to pull the climbing rope attached to line 54 up and through pulley 48. The failure of the adhesive allows lead line 54 to detach from pulley 48 when the climbing rope is pulled up and through pulley 48.

When a climber applies the load of his/her body to the climbing rope and the pulley 48, the semi-rigid cable 34 will deform and bend downwardly toward the surface of the obstacle. Thus, for the purpose of this patent application, "semi-rigid" means that the cable is rigid enough to maintain the pulley 48 in a centered position along axis E during the flight cycle of the projectile 14 and flexible enough to bend downward when loaded by the weight of an adult human being. The ability of the cable 34 to bend downward decreases the moment applied to the penetrator 16 embedded in the obstacle, compared to a cable that does not bend downward under the weight of a climber.

Test Results

Various prototypes of the invention were tested in varying environments. Using a penetrator 16 made of tungsten (⅜ inch diameter and 2.5 inches long), it was determined that a muzzle velocity of 1200 feet per second is needed to penetrate six inches into reinforced concrete. Prototypes of projectile 14 using a steel penetrator 16 launched from a compressed air gun showed that the lead line 54 properly deployed and remained adhered to the pulley 48 after impact. Other tests using a steel penetrator 16 and an air gun showed that the sabot 50 discarded properly and the fin assembly 52 provided stability during projectile flight.

While the invention has been described with reference to certain embodiments, numerous changes, alterations and modifications to the described embodiments are possible without departing from the spirit and scope of the invention as defined in the appended claims, and equivalents thereof.

What is claimed is:

1. A gun-launched, penetrating anchor projectile having a central longitudinal axis, comprising:

an elongated penetrator made of a dense metallic material and centered on the central longitudinal axis, the elongated penetrator having an aft end that tapers in an aft direction and a central bore extending forward from the aft end;

an expandable anchor in the form of a hollow cylinder disposed aft of the elongated penetrator and centered on the central longitudinal axis;

a spacer made from a brittle material in the form of a hollow cylinder, the spacer being disposed aft of the expandable anchor and centered on the central longitudinal axis;

a hammer made from a second dense metallic material in the form of a hollow cylinder, the hammer being disposed aft of the spacer and centered on the central longitudinal axis;

a guide tube in the form of a tube centered on the central longitudinal axis and disposed radially inward of the expandable anchor, the spacer and the hammer;

an outer sheath that encloses the elongated penetrator, the expandable anchor, the spacer and the hammer;

a semi-rigid cable fixed at one end in the central bore of the elongated penetrator and extending in the aft direction through hollow interiors of the expandable anchor, the spacer, and the hammer;

a pulley having a through bore, another end of the semi-rigid cable forming a loop that extends through the through bore of the pulley;

a discarding sabot disposed around the projectile; and a fin assembly disposed around the projectile aft of the discarding sabot and forward of the pulley.

2. The projectile of claim 1, further comprising a lead line extending around the pulley through the loop of the semi-rigid cable.

3. The projectile of claim 2, further comprising masses fixed to respective free ends of the lead line.

4. The projectile of claim 3, wherein the lead line is fixed to the pulley at an approximate mid-point of the lead line.

5. The projectile of claim 2, wherein the lead line has a diameter in a range of about 0.2 mm to about 1.5 mm.

6. The projectile of claim 1, wherein the dense metallic material of the elongated penetrator has a density of at least 10 grams/cubic centimeter.

7. The projectile of claim 6, wherein a forward end of the elongated penetrator is tapered in a forward direction.

8. The projectile of claim 7, wherein the second dense metallic material of the hammer has a density of at least 10 grams/cubic centimeter.

9. The projectile of claim 8, wherein the second dense metallic material comprises tungsten.

10. The projectile of claim 9, wherein the guide tube comprises aluminum.

11. The projectile of claim 10, wherein the outer sheath comprises copper.

12. The projectile of claim 7, wherein the expandable anchor includes at least two longitudinal slits formed therein, the slits beginning at a forward end of the anchor and extending aft and being circumferentially equally spaced apart from each other.

13. The projectile of claim 6, wherein the dense metallic material comprises tungsten.

* * * * *